US009706893B2

(12) United States Patent
Wall et al.

(10) Patent No.: US 9,706,893 B2
(45) Date of Patent: Jul. 18, 2017

(54) LIQUID EXTRACTION CLEANING DEVICE AND METHOD

(71) Applicant: Rug Doctor, LLC, Plano, TX (US)

(72) Inventors: Timothy Wall, Plano, TX (US); Ann Marie Morrow, Plano, TX (US); Walter Haug, Plano, TX (US); Phuong Le, St. Charles, MO (US); Charles Michael Ostendorf, St. Clair, MO (US); Schubert Pereira, Fenton, MO (US); Ernest Matthew Chavana, Jr., Fenton, MO (US); Vincent Lau, Fenton, MO (US); Jason Edward Hill, St. Louis, MO (US); Jason Tilk, Cleveland, OH (US); Evan Spirk, Cleveland, OH (US); Lindsey Tufts, Cleveland, OH (US); Craig Saunders, Cleveland, OH (US); Paul Stephens, Cleveland, OH (US)

(73) Assignee: RUG DOCTOR, LLC, Plano, TX (US)

( * ) Notice: Subject to any disclaimer, the term of this patent is extended or adjusted under 35 U.S.C. 154(b) by 377 days.

(21) Appl. No.: 14/608,548

(22) Filed: Jan. 29, 2015

(65) Prior Publication Data

US 2015/0245750 A1 Sep. 3, 2015

Related U.S. Application Data

(60) Provisional application No. 61/946,434, filed on Feb. 28, 2014.

(51) Int. Cl.

| | |
|---|---|
| ***A47L 7/00*** | (2006.01) |
| ***A47L 11/40*** | (2006.01) |
| ***A47L 11/30*** | (2006.01) |
| ***A47L 11/34*** | (2006.01) |

(52) U.S. Cl.

CPC ..... *A47L 11/4072* (2013.01); *A47L 11/34* (2013.01); *A47L 11/4002* (2013.01); *A47L 11/4036* (2013.01); *A47L 11/4044* (2013.01); *A47L 11/4075* (2013.01); *A47L 11/4088* (2013.01)

(58) Field of Classification Search

CPC .. A47L 11/4072; A47L 11/34; A47L 11/4002; A47L 11/4036; A47L 11/4044; A47L 11/4075; A47L 11/4088

See application file for complete search history.

(56) References Cited

U.S. PATENT DOCUMENTS

| | | | |
|---|---|---|---|
| 5,309,600 | A | 5/1994 | Weaver et al. |
| 5,311,638 | A | 5/1994 | Furcron et al. |
| 5,455,984 | A | 10/1995 | Blase |

(Continued)

*Primary Examiner* — Dung Van Nguyen

(74) *Attorney, Agent, or Firm* — Thompson Coburn, LLP; Matthew J. Himich

(57) ABSTRACT

A liquid extraction cleaning device comprises a main unit, a liquid pump, a flexible hose, and a hand tool. The main unit comprises a vacuum pump. The hand tool comprises a vacuum inlet port, an agitator, a spray nozzle, and a grip portion. The vacuum inlet port of the hand tool is operatively connected to the vacuum pump via the hose passageway in a manner such that the vacuum pump is capable of drawing fluid through the vacuum inlet port and into the hose passageway. The spray nozzle is operatively connected to the liquid pump in a manner such that the liquid pump is capable of forcing liquid out of the spray nozzle.

12 Claims, 11 Drawing Sheets

(56) References Cited

U.S. PATENT DOCUMENTS 5,483,726 A 1/1996 Blase et al.
5,542,147 A * 8/1996 Merten ..... A47L 11/34 15/321
5,655,255 A 8/1997 Kelly
5,784,753 A * 7/1998 Kaczmarz ..... A47L 7/0009 15/319
5,799,362 A 9/1998 Huffman
5,806,767 A * 9/1998 Polti ..... A47L 9/2836 239/135
5,836,046 A 11/1998 Huffman et al.
5,867,864 A * 2/1999 Miller ..... A47L 9/0416 15/322
5,937,475 A 8/1999 Kasen et al.
6,134,746 A 10/2000 Miller et al.
6,374,452 B1 4/2002 Essex et al.
6,550,098 B2 4/2003 Roberts et al.
6,658,693 B1 12/2003 Reed, Jr.
6,775,880 B2 8/2004 Kasper et al.
6,934,993 B1 8/2005 Huffman et al.
6,968,593 B1 11/2005 Lenkiewicz et al.
7,073,226 B1 7/2006 Lenkiewicz et al.
7,203,991 B2 4/2007 Stephens et al.
7,225,503 B1 6/2007 Lenkiewicz et al.
7,578,025 B2 * 8/2009 Kostreba ..... A46B 13/008 15/321
7,631,386 B1 12/2009 Santiago et al.
8,122,562 B2 2/2012 Krebs
8,549,697 B1 10/2013 Moyher, Jr. et al.
8,991,000 B2 3/2015 Huffman et al.
2003/0177595 A1 * 9/2003 Quach ..... B60S 3/048 15/29
2006/0288518 A1 12/2006 Lenkiwicz et al.
2007/0157418 A1 7/2007 Zahuranec et al.
2009/0165822 A1 7/2009 Kintz et al.
2013/0263404 A1 10/2013 Hill et al.
2013/0318741 A1 * 12/2013 Moyher, Jr. ..... A47L 5/362 15/327.1
2015/0351597 A1 12/2015 Wild et al.

* cited by examiner

LIQUID EXTRACTION CLEANING DEVICE AND METHOD

CROSS-REFERENCE TO RELATED APPLICATIONS

This patent application claims the benefit of provisional patent application Ser. No. 61/946,434, which was filed on Feb. 28, 2014.

STATEMENT REGARDING FEDERALLY SPONSORED RESEARCH OR DEVELOPMENT

Not applicable.

APPENDIX

Not applicable.

BACKGROUND OF THE INVENTION

Field of the Invention

The present invention pertains to liquid extraction cleaning devices of the type that spray cleaning liquid onto surfaces and thereafter suck the liquid back up to clean such surfaces. More specifically, the present invention pertains to liquid extraction cleaning devices that are used to clean carpet or upholstery and that store the cleaning solution and recovered liquid onboard.

General Background

Some carpet and upholstery extraction cleaners are known in the industry as floor cleaners and some are known as spot cleaners.

A typical floor cleaner comprises a wheeled main unit that rests on the floor and comprises one or more liquid spray nozzles, one or more agitators, and one or more vacuum intake nozzles beneath the main unit. As the main unit of such a floor cleaner is dragged over carpet, liquid spray is discharged from the main unit. The agitator of the main unit is then used to work the liquid into the carpet. Following the agitation, the vacuum intake nozzles of the main unit extract as much of the soiled liquid from the carpet as possible. It is common for floor cleaners to be configured to perform all of these actions simultaneously, albeit on different portions of the carpet. Thus, as the main unit is dragged or self-propelled over carpet, the spraying, agitating, and vacuuming occurs sequentially on any given portion of the carpet.

Spot cleaners tend to be smaller than floor cleaners and are typically used to pick up spills, remove localized stains, or clean furniture upholstery. Some spot cleaners are merely handheld devices that comprise the same general features of the larger floor cleaners, but without the wheels. Other spot cleaners comprise a hand tool that is attached to a main unit via a flexible hose. With such hand tool spot cleaners, the hand tool performs the spraying and the vacuuming and may or may not perform agitation. The vacuum motor and most other necessary components of such hand tool spot cleaners are contained in the main unit. Many floor cleaners are provided with an accessory hand tool and hose that allow the floor cleaners to also serve as spot cleaners.

SUMMARY OF THE INVENTION

The present invention is directed to spot cleaner liquid extraction devices. More specifically, the present invention is directed to spot cleaners of the type having a hand tool connected to a main unit via a hose.

In one aspect of the invention, a liquid extraction cleaning device comprises a main unit, a liquid pump, a flexible hose, a hand tool, and an electrical cable. The main unit comprises a vacuum pump. The flexible hose surrounds a hose passageway and is operatively connected to the vacuum pump in a manner such that the vacuum pump is capable of drawing fluid through the hose passageway. The hand tool comprises a vacuum inlet port, an agitator, an electric motor, a spray nozzle, and a grip portion. The hand tool is connected to the main unit by the flexible hose such that the hand tool is movable relative to the main unit. The vacuum inlet port is operatively connected to the vacuum pump via the hose passageway in a manner such that the vacuum pump is capable of drawing fluid through the vacuum inlet port and into the hose passageway. The spray nozzle is operatively connected to the liquid pump in a manner such that the liquid pump is capable of forcing liquid out of the spray nozzle. The electric motor is operatively connected to the agitator in a manner such that operation of the electric motor causes the agitator to move relative to the grip portion. The electrical cable extends within and along the hose passageway. The electrical cable is operatively connected to the electrical motor of the hand tool and to the main unit in a manner such that the electrical cable can supply electrical power to the electric motor from the main unit.

In another aspect of the invention, a liquid extraction cleaning device comprises a main unit, a liquid pump, a flexible hose, and a hand tool. The main unit comprises a vacuum pump. The flexible hose surrounds a hose passageway and is operatively connected to the vacuum pump in a manner such that the vacuum pump is capable of drawing fluid through the hose passageway. The hand tool comprises a vacuum inlet port, a powered agitator, a spray nozzle, a grip portion, an agitator switch, and a spray switch. The hand tool is connected to the main unit by the flexible hose such that the hand tool is movable relative to the main unit. The vacuum inlet port is operatively connected to the vacuum pump via the hose passageway of the flexible hose in a manner such that the vacuum pump is capable of drawing fluid through the vacuum inlet port and into the hose passageway. The spray nozzle is operatively connected to the liquid pump in a manner such that the liquid pump is capable of forcing liquid out of the spray nozzle. The powered agitator is moveable relative to grip portion. The agitator switch is configured and adapted to control the operation of the powered agitator. The spray switch is configured and adapted to control whether the liquid pump receives electricity. The powered agitator is between the vacuum inlet and the spray nozzle, and the spray nozzle is between the grip portion and the agitator.

In yet another aspect of the invention, a liquid extraction cleaning device comprises a main unit, a liquid pump, a flexible hose, a hand tool, a telescoping tow handle, and a pair of wheels. The main unit comprises a vacuum pump and a base. The base has a bottom surface that is configured to contact a floor and at least partially support the liquid extraction device from the floor when the liquid extraction cleaning device is in an upright position. The flexible hose surrounds a hose passageway and is operatively connected to the vacuum pump in a manner such that the vacuum pump is capable of drawing fluid through the hose passageway. The hand tool comprises a vacuum inlet port and a spray nozzle and is connected to the main unit by the flexible hose such that the hand tool is movable relative to the main unit. The vacuum inlet port is operatively connected to the vacuum pump via the hose passageway in a manner such that the vacuum pump is capable of drawing fluid through the vacuum inlet port and into the hose passageway. The spray nozzle is operatively connected to the liquid pump in a manner such that the liquid pump is capable of forcing liquid out of the spray nozzle. The telescoping tow handle is attached to the main unit and is selectively adjustable between a retracted configuration and an extended configuration. The telescoping tow handle is configured and adapted to allow a person to tilt and tow the liquid extraction cleaning device when the telescoping tow handle is in the extended configuration. The pair of wheels are mounted to the base of the main unit and are configured to support the main unit above a floor when the liquid extraction cleaning device is tilted and towed. The wheels are mounted to the base of the main unit in a manner such that the bottom surface of the base contact will contact and at least partially support the liquid extraction device from the floor when the liquid extraction cleaning device is upright.

In still another aspect of the invention, a liquid extraction cleaning device comprises a main unit, a liquid pump, a flexible hose, and a hand tool. The main unit comprises a vacuum pump and a hose storage receptacle. The flexible hose surrounds a hose passageway. The flexible hose is operatively connected to the vacuum pump in a manner such that the vacuum pump is capable of drawing fluid through the hose passageway. At least a majority of the flexible hose is selectively storable in the hose storage receptacle. The hose storage receptacle is oriented on the main unit such that a majority of the flexible hose can be selectively removed from the hose storage receptacle from one side of the liquid extraction cleaning device. The hand tool comprises a vacuum inlet port and a spray nozzle and is connected to the main unit by the flexible hose such that the hand tool is movable relative to the main unit. The vacuum inlet port is operatively connected to the vacuum pump via the hose passageway in a manner such that the vacuum pump is capable of drawing fluid through the vacuum inlet port and into the hose passageway. The spray nozzle is operatively connected to the liquid pump in a manner such that the liquid pump is capable of forcing liquid out of the spray nozzle.

Further features and advantages of the present invention, as well as the operation of the invention, are described in detail below with reference to the accompanying drawings.

Figure 1:
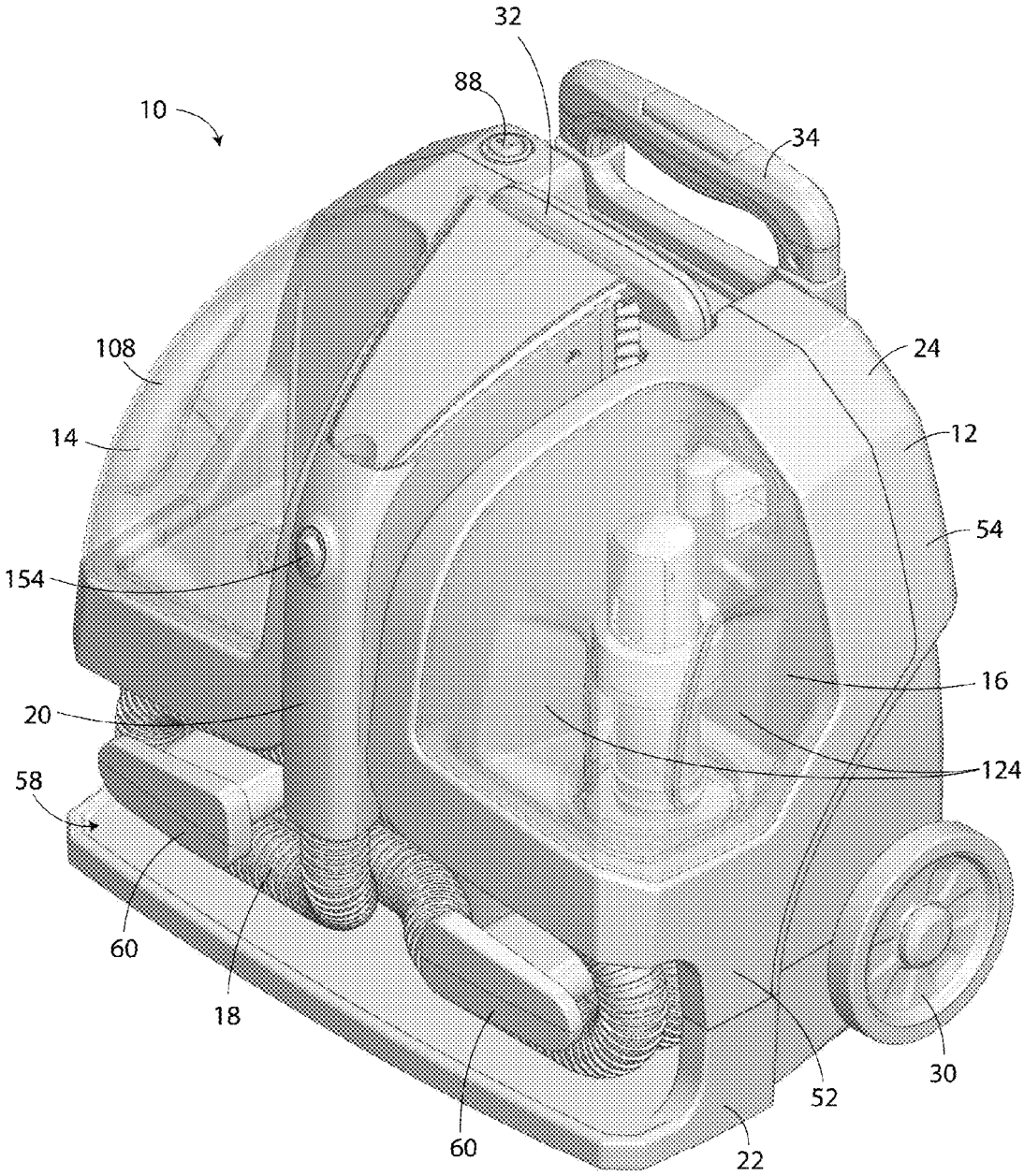
FIG. 1 is a perspective view of the preferred embodiment of an extraction cleaner in accordance with the invention, showing the extraction cleaner's handles retracted.

Reference numerals in the written specification and in the drawing figures indicate corresponding items.

DETAILED DESCRIPTION

A preferred embodiment of a liquid extraction cleaning device in accordance with the invention is shown in FIGS. 1-11. The extraction cleaner 10 comprises a main unit 12, a solution tank assembly 14, a recovery tank assembly 16, a flexible vacuum hose 18, and a hand tool 20.

Figure 4:
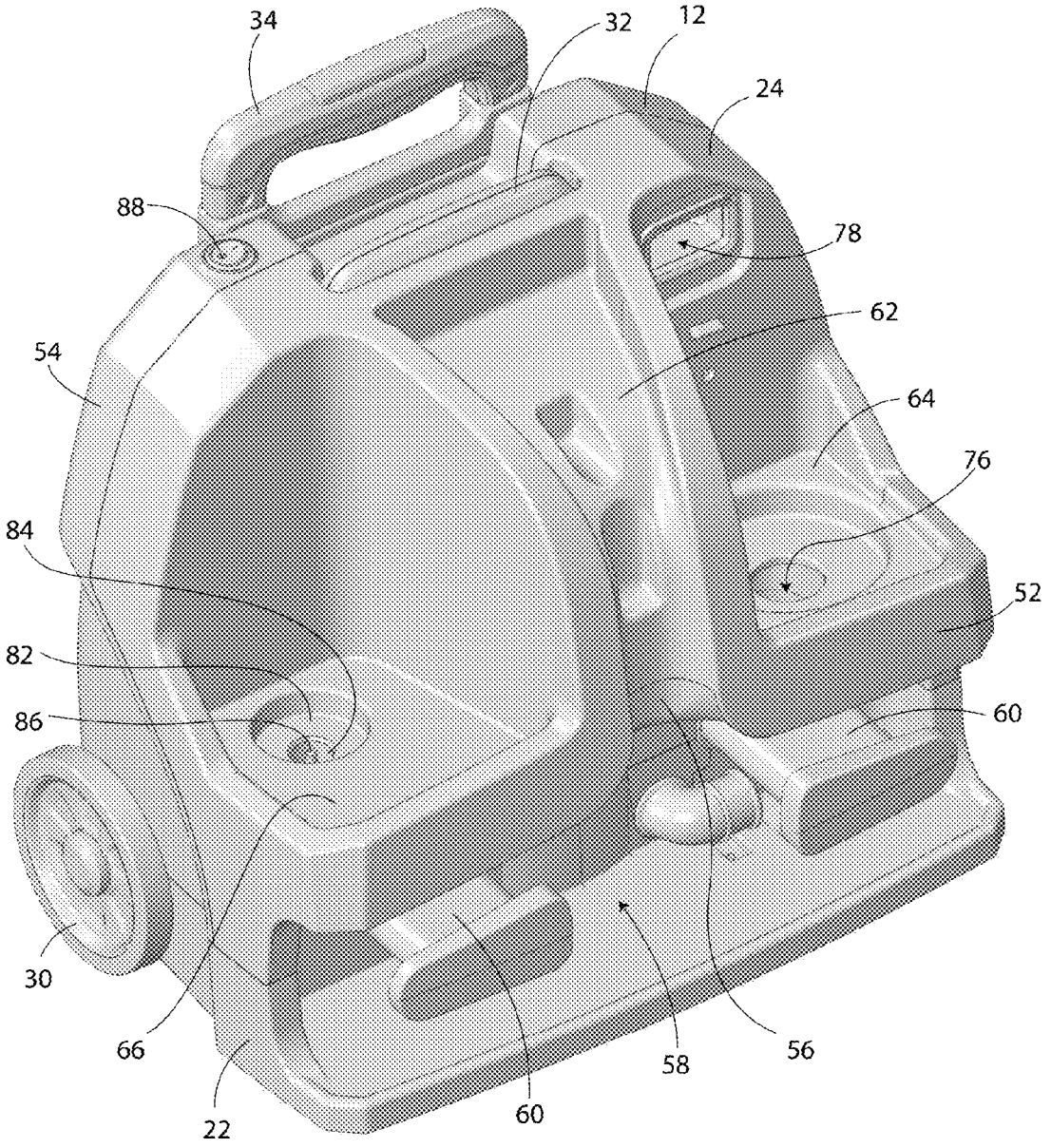
FIG. 4 is a perspective view of the main unit of the extraction cleaner.

As shown by itself in FIG. 4, the main unit 12 comprises a base 22 and an upper shell 24 that collectively form an interior cavity that holds various operational components of the extraction cleaner 10. Such components include a vacuum pump 26, a liquid pump 28 (both shown in FIG. 6), and an electrical circuit board assembly (not shown, but attached to the inner surface of the upper shell 24). The vacuum pump 26 and liquid pump 28 are each preferably adapted to operate on standard household voltage. Preferably, the vacuum pump 26 is of the type wherein the rotor drives both a main impeller and a cooling fan. The circuit board assembly probably comprises a transformer and rectifier for supplying the hand tool 20 with low voltage DC power. Other components are also secured to the main unit 12 including a pair of wheels 30, a carrying handle 32, and a tow handle assembly 34.

Figure 6:
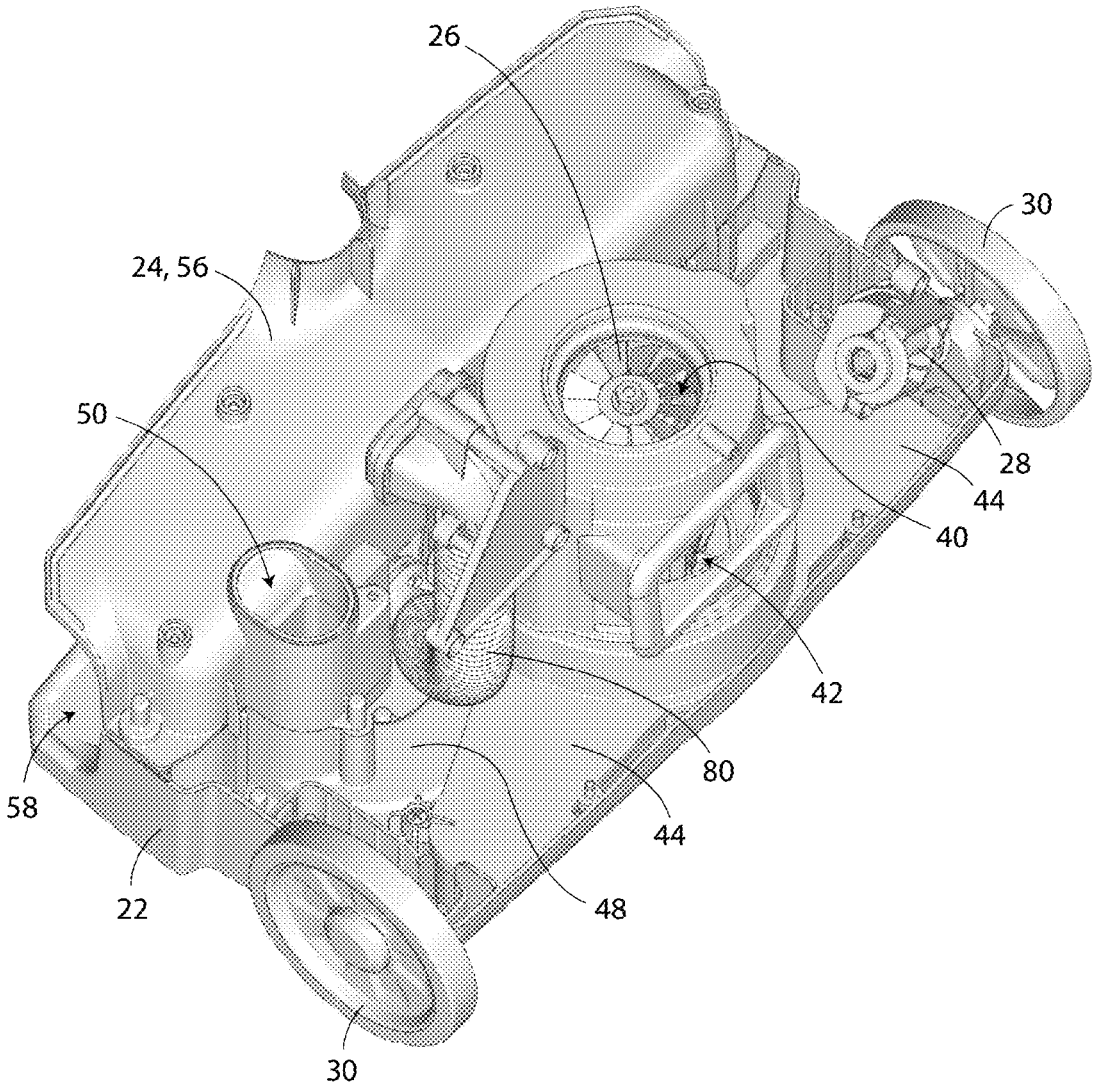
FIG. 6 is a perspective view of portion of the main unit of the extraction cleaner, revealing the interior of the main unit.
Figure 7:
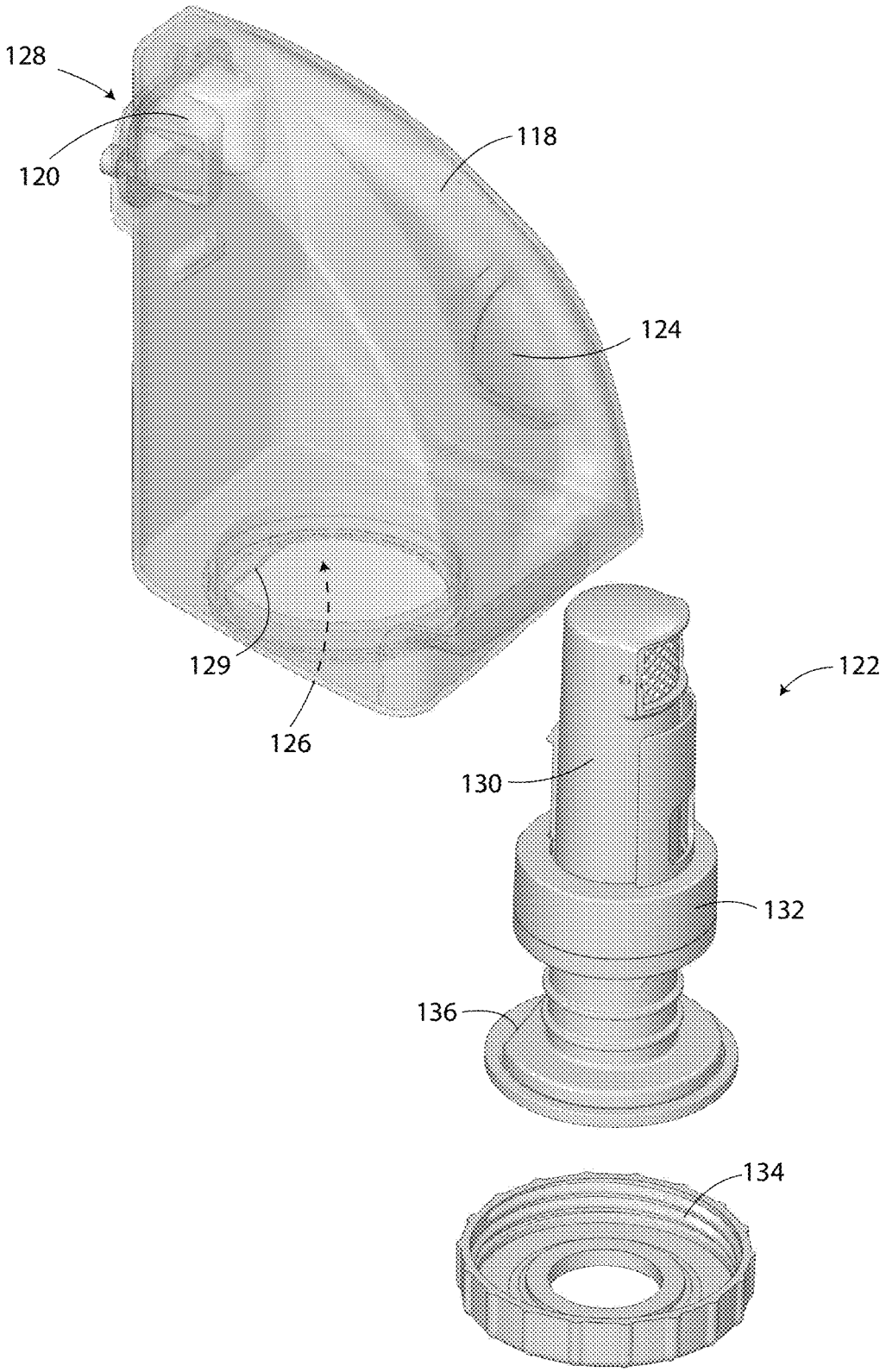
FIG. 7 is an exploded view of the recovery tank assembly of the extraction cleaner.

As shown in FIG. 6, the base 22 of the main unit 12 provides mountings for the vacuum pump 26 and the wheels 30. The wheels 30 are mounted to the base 22 on opposite sides of the main unit 12 adjacent to the rear of the main unit. The base 22 also partially forms air ducts 36, which are also formed by duct members that are attached to the base and/or each other. One such duct member covers much of the vacuum pump 26 and comprises a cooling fan air inlet 40 and primary air outlet 42, which are not operatively connected to each other. That same duct member and the base 22 collectively define cooling fan air ducts 44 which are operatively connected to cooling fan air outlets 46 formed on opposite sides of the rear of the base (see FIG. 3). A primary air intake duct 48 is also formed and extends upward to an inlet 50 that, as explained below, interfaces with the upper shell 24 of the main unit. The primary air intake duct 48 is operatively connected to the primary air outlet 42 through the impeller of the vacuum pump 26.

Figure 2:
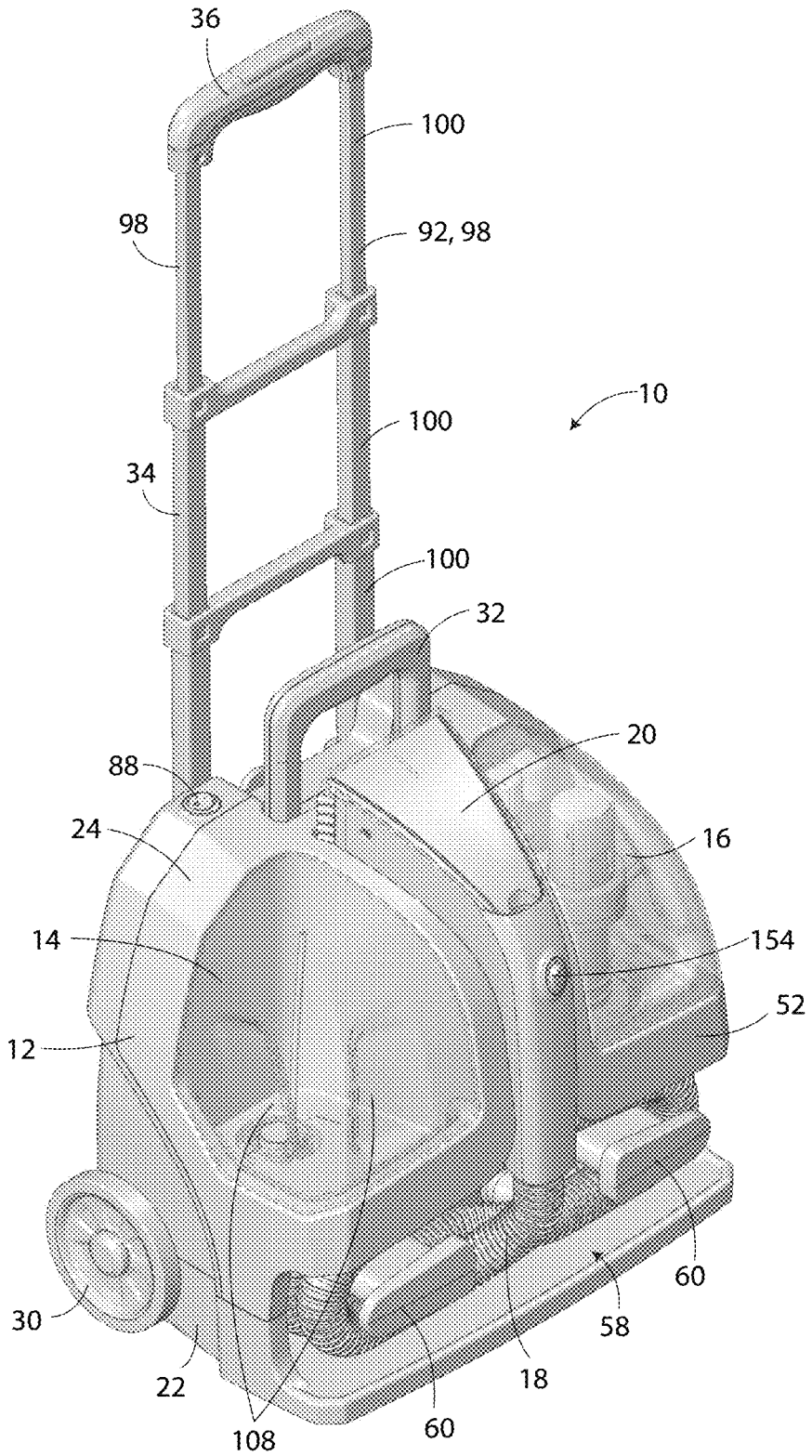
FIG. 2 is a perspective view of the extraction cleaner with the handles extended.
Figure 3:
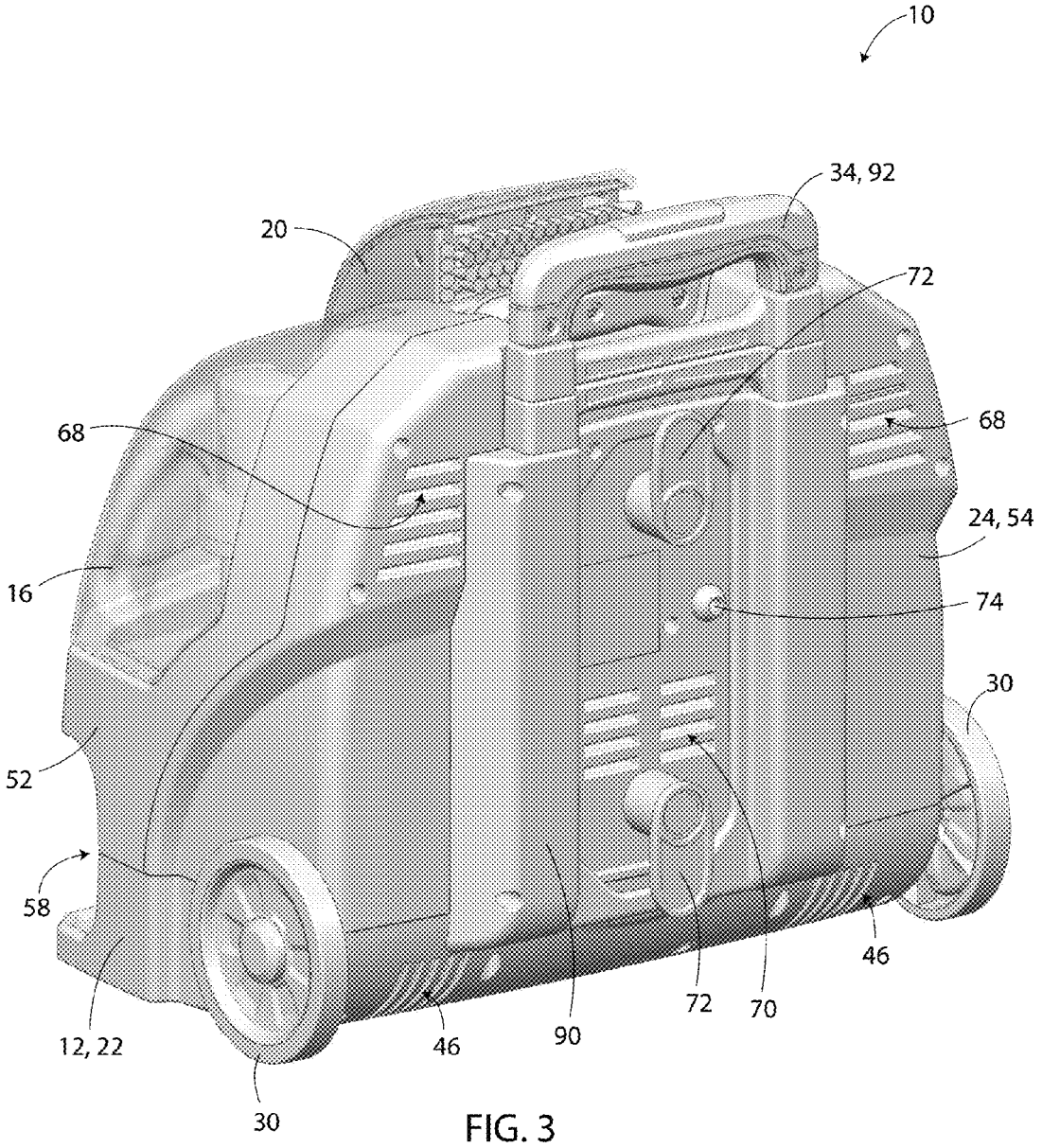
FIG. 3 is a perspective view of the extraction cleaner showing the rear of the extraction cleaner.

As shown in the figures, the upper shell 24 of the main unit 12 is preferably formed by a front shell piece 52, a rear shell piece 54, and a lower facing shell piece 56 (shown in FIG. 6). The lower facing shell piece 56 and the front portion of the base 22 collectively form a hose storage receptacle 58. A pair of hose wrap protrusions 60, about which the hose 18 can be wrapped, are mounted between the base 22 and the lower facing shell piece 56 in the hose storage receptacle 58. The upper shell 24 also comprises a recessed cradle 62, a recovery tank support platform 64, and a solution tank support platform 66. The recessed cradle 62 is formed centrally on the front and part of the top of the upper shell 24 between a recovery tank support platform 64 and a solution tank support platform 66 and is adapted to readably hold the hand tool 20 during storage. The rear of the upper shell 24 comprises a pair of cooling air inlets 68 and a primary exhaust outlet 70. A pair of electrical cord wrap protrusions 72 are centrally mounted to the rear of the upper shell 24 for storage of the extraction cleaner's 10 electrical cord (which is not shown but extends through the cord hole 74 provided in the rear of the upper shell and attaches to the circuit board assembly). An opening 76 is centrally formed through the recovery tank support platform 64 and is operatively connected to the inlet 50 of the primary air intake duct 48. Another opening 78 above the recovery tank support platform 64 near the top of the upper shell 24 extends through the upper shell and is attached to a connecting duct assembly 80 (see FIG. 6), which operatively connects that opening 78 to the hose 18. Two of concentric cylindrical recesses 82, 84 are centrally formed in the solution tank support platform 66 and a small protrusion 86 extends upwardly from the center of the smaller/deeper liquid transfer recess 84. A small offset hole (not shown) is formed through the upper shell 24 in the liquid transfer recess 84 and is operatively connected to the liquid pump 28 via tubing. The carrying handle 32 has an inverted U-shape and is attach to the upper shell 24 in a manner such that it can partially retract into the interior of the main unit 12 (as shown in FIGS. 1, 3, and 4). To a limit, the carrying handle can be extended out of the interior of the main unit 12 (as shown in FIG. 2). Still further, a main power switch 88 is secured to the top of the upper shell 24 near the rear of the main unit 12.

Figure 5:
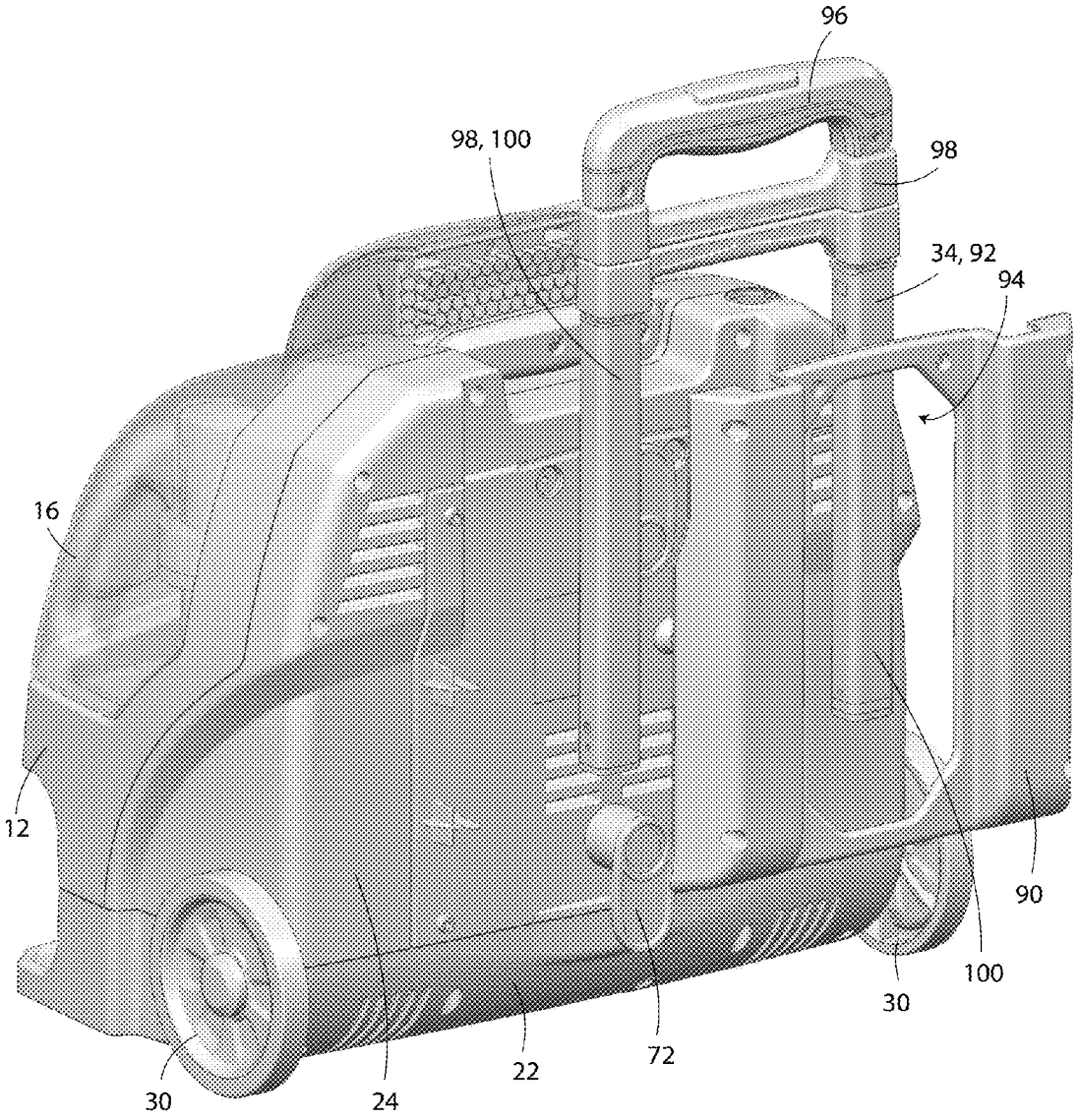
FIG. 5 is an exploded perspective view showing the rear of the extraction cleaner with the tow handle assembly detached from the main unit.

As shown in FIGS. 3 and 5, the towing handle assembly 34 includes a shroud 90 and a telescoping tow handle 92. The shroud 34 attaches to the upper shell 24 and comprises a central opening 94 through which the cord wrap protrusions 72 extend, and that prevents the shroud from blocking the primary exhaust outlet 70. The tow handle 92 comprises a cross member grip 96 and pair of telescoping leg members 98. The grip 96 extends from one of the telescoping leg members 98 to the other. Each telescoping leg member comprises a plurality of leg segments 100. The shroud 90 and the upper shell 24 fix the lower most leg segments in position relative to the upper shell. As such, the cross member grip 96 can be extended up from the shroud 90 (FIG. 2) for towing the extraction cleaner 10 via the wheels 30 and, alternatively, lowered such that the majority of the telescoping tow handle 92 is retracted into the shroud (FIG. 1). When the extraction cleaner is stowed or is not being towed, the front of the bottom surface of the base 22 of the main unit 12 rest on the ground to prevent the extraction cleaner from sliding around on its wheels 30.

Figure 8:
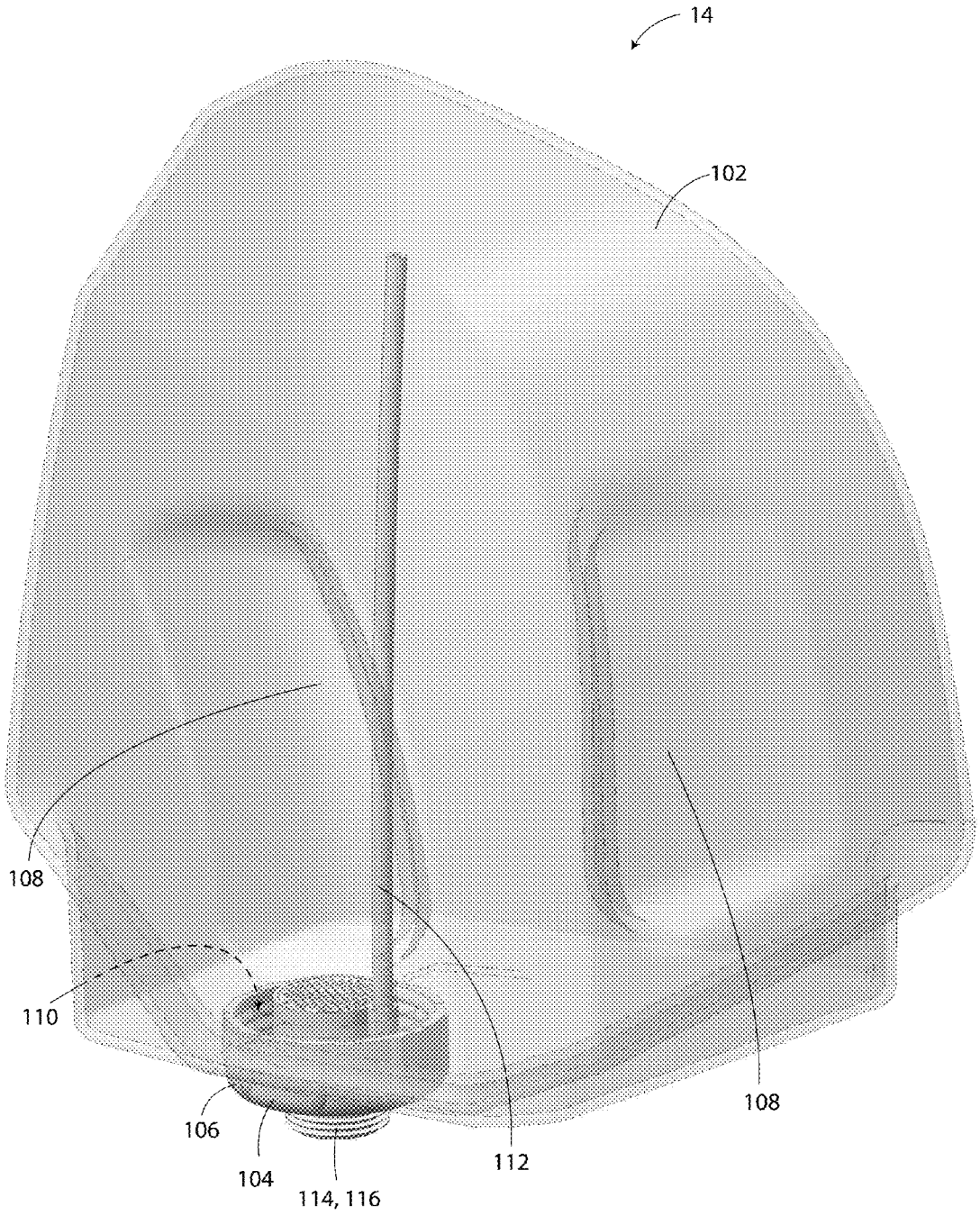
FIG. 8 is a perspective view of the solution tank assembly of the extraction cleaner.

As shown by itself in FIG. 8, the solution tank assembly 14 of the extraction cleaner 10 comprises a solution tank 102, a fluid communication assembly 104, and a locking ring 106. The solution tank 102 is preferably translucent plastic and comprises handgrip indentations 108 and a central opening 110 at its base that is preferably treaded. The fluid communication assembly 104 comprises offset air vent tube 112 that is configured to operatively communicate with the vent recess 82 on the solution tank support platform 66 of the main unit 12 in a manner such that air can enter the solution tank 102 through the vent tube 112 above the level of liquid in the tank. The fluid communication assembly 104 also comprises a spring biased check valve 114 that enables fluid within the solution tank to exit through the valve when it's open. The check valve 114 is configured to open when the solution tank assembly 14 is placed onto the solution tank support platform 66. More specifically, the lowermost end of the check valve comprises an annular seal 116 that slides into the smaller liquid transfer recess 84, and the protrusion 86 in the recess forces the check valve open 114. Thus, when attached to the main unit 12, liquid in the solution tank 102 is in fluid communication with the liquid pump 28 of the main unit, and air is able to fill the tank a liquid is drawn out of the tank by the pump. The locking ring 106 releasably connects fluid communication assembly 104 of the solution tank assembly 14 to the central opening 110 at the base of the solution tank 102 to allow the tank to be refilled easily.

The recovery tank assembly 16 includes a recovery tank 118, a deflector 120, and a float assembly 122. The recovery tank 118 is preferably is preferably translucent and comprises a pair of handgrip indentations 124, a central opening 126 at its base that is preferably threaded, and an intake opening 128 on its upper rear wall. The central opening preferably is not perfectly circular and includes flat portion 129. The deflector 120 is connected to the intake opening 128 and is configured to deflect fluid (air and extracted liquid) away from the float assembly 122 and against the outer walls of the recovery tank 118. When the recovery tank assembly 16 is placed on the recovery tank support platform 64 of the main unit, the intake opening 128 of the recovery tank 118 is operatively connected to the connecting duct assembly 80 of the main unit, which draws extracted liquid and air into the recovery tank 118. The float assembly 122 comprises an air tube 130, a locking ring 132, and a float 134. The float assembly 122 is removably attached to the central opening 126 of the recovery tank 118 via the locking ring 132. Notably, the flange at the base of the air tube 130 comprises a flat portion 136 that must be aligned with the flat portion 129 of the central opening 126 of the recovery tank 118 in order to attach the float assembly 122 to the recovery tank 118. This ensures that air tube 130 is oriented with its intake facing away from the deflector 120. When the recovery tank assembly 16 is placed on the recovery tank support platform 64 of the main unit 12, the air tube 130 is operatively connected to the impeller of the vacuum pump 26 via the primary air intake duct 48 of the main unit 12, thereby allowing air to be drawn out of the recovery tank 118 to thereby draw air and extracted liquid into the tank. The float 132 encircles the air tube 130 and, in a conventional manner, is configured to rise with the level of liquid in the recovery tank 118 until it reaches a maximum limit, at which time is seals off the upper end of the air tube to prevent further intake of fluid.

The flexible vacuum hose 18 connects the hand tool 20 to the connecting duct assembly 80 of the main unit 12 and forms and surrounds a hose passageway. As such that the impeller of the vacuum pump 26 is operatively connected to the hose passageway. An electrical cable 138 and a liquid supply tube 140 (shown in FIG. 9) extend through the hose passageway. The liquid supply tube is operatively connected to the high side of the liquid pump 28 of the main unit 12. The electrical cable 138 is connected to the circuit board of the main unit 12 in a manner such that the electrical cable is feed with low voltage direct current (preferably under 25 volts). The electrical cable 138 preferably comprises three wires, namely positive, negative, and a relay signal wire. Because power transmission via low voltage requires higher amperage, running the electrical cable 138 in the hose passageway rather than spirally in the hose wall or external to the hose minimizes power loss due to wire resistance. Additionally, running both the electrical cable 138 and the liquid supply tube 140 in the hose passageway eliminates routing issues and allows the vacuum hose 18 manufactured relatively inexpensively.

Figure 9:
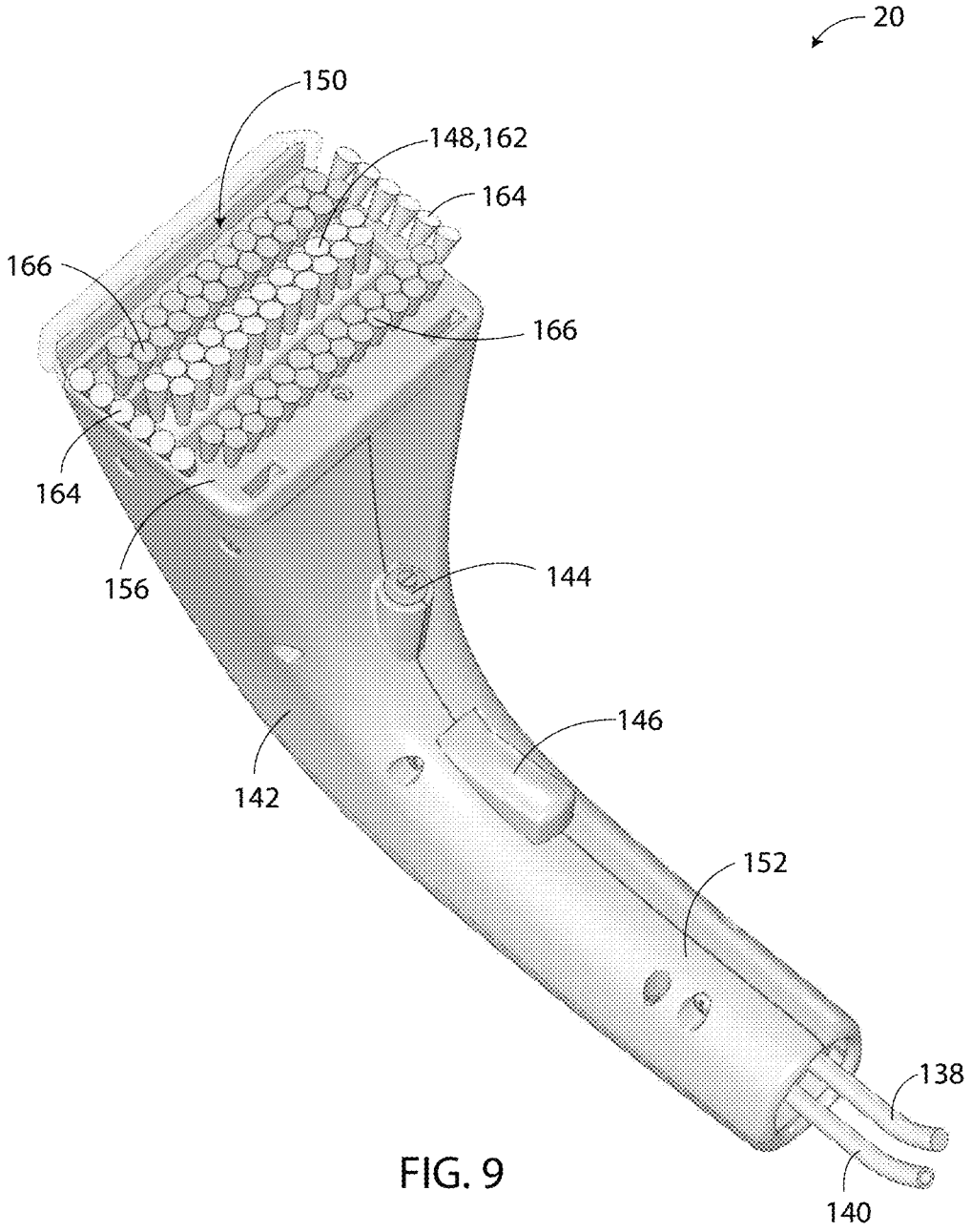
FIG. 9 is a perspective view of the hand tool of the extraction cleaner showing the bottom of the hand tool.

As shown in FIG. 9, the hand tool 20 comprises a housing 142, a spray nozzle 144, a spray trigger 146, an agitator assembly 148, a vacuum inlet port 150, a grip portion 152, and an agitator switch 154 (the latter shown in FIGS. 1 and 2). The end of the grip portion 152 is connected to the flexible vacuum hose 18, thereby connecting the hose passageway to the vacuum inlet port 150. A portion of the housing 142 adjacent to the vacuum inlet port 150 is preferably translucent such that liquid passing into the vacuum inlet port can be observed. The spray nozzle 144 is preferably directly connected to the liquid supply tube 140 that extends through the vacuum hose 18 such that when the liquid pump 28 of the main unit 12 operates, cleaning solution liquid is sprayed from the spray nozzle in a fan-like pattern. However, the spray trigger 146 is connected to the electrical cable 138 and operates an electrical switch in the hand tool 20 and sends the positive low voltage down the signal wire of the electrical cable to the circuit board of the main unit 12 when the trigger is depressed. Through a relay, the circuit board only supplies the higher AC power to the liquid pump 28 when it receives that signal. The agitator switch 154 is also connected to the electrical cable 138, but is preferably a toggle switch that selectively supplies electrical power to the agitator assembly 148. The various components of the hand tool 20 are positioned such that as a person pulls the grip portion 152 of the tool and drags the remainder of the tool along upholstery or carpet, the hand tool will spray cleaning liquid on the fabric, then agitate that portion of the fabric, and thereafter extract the soiled liquid from the fabric, all in a single motion.

Figure 10:
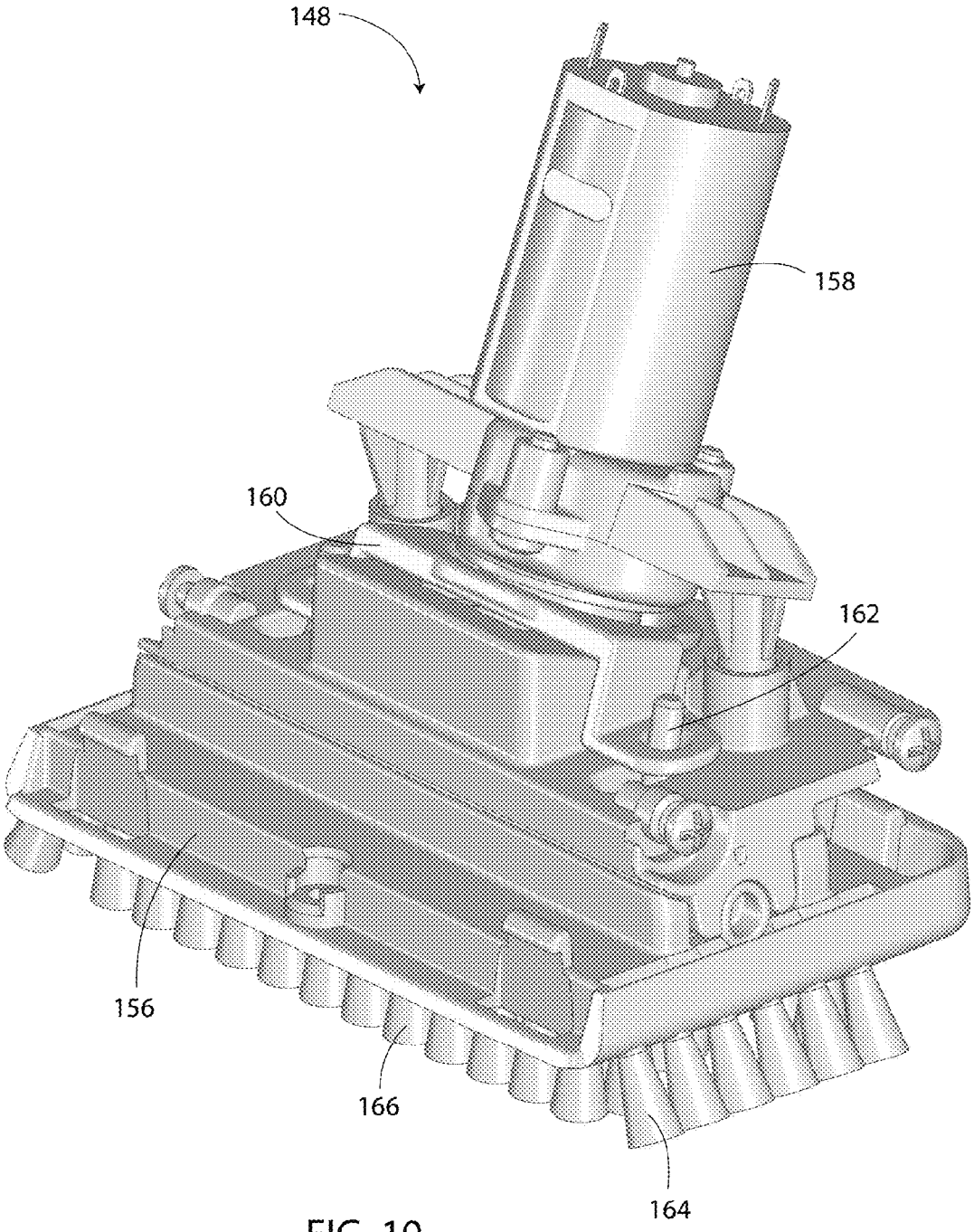
FIG. 10 is a perspective view of the agitator assembly of the hand tool.
Figure 11:
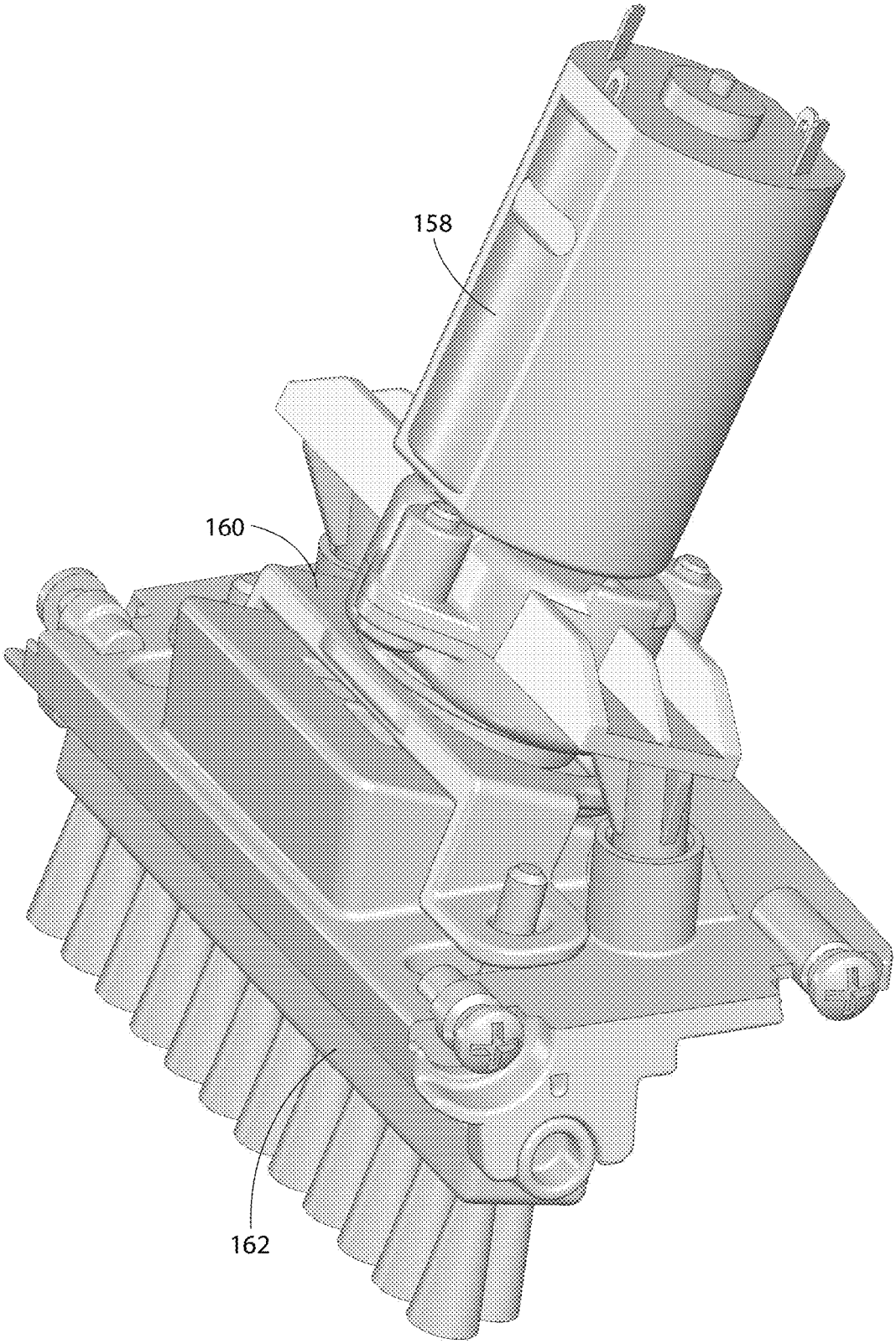
FIG. 11 is a perspective view of the agitator assembly of the hand tool with the fixed brush ring removed from the assembly.

The agitator assembly 148 is shown in FIGS. 10 and 11 and comprises a fixed brush ring 156, a low voltage electric motor 158, a motion converter 160, and a reciprocating agitator 162. The fixed brush ring 156 preferably comprises side brushes 164 that are preferably oriented such that they extend at angle relative to the surface being cleaned, and several rows of non-angled brushes 164 in front of and behind the reciprocating agitator 162. The electric motor 158 supplies rotational power to the motion converter 160 when agitator switch 154 of the hand tool 20 supplies the agitator assembly 148 with power. The motion converter 160 converts that rotational power into linearly reciprocating power, which thereafter is converted once again into pivotally reciprocation of the agitator 162.

The main power switch 88 on the main unit 12 controls the electrical power supply to the rest of extraction cleaner 10. When set to the on position, the main power supply supplies power to the circuit board which then activates the vacuum pump 26. Thus, when the main switch 88 is on, the vacuum pump operates 26, and when it's off, nothing operates. However, when the main power switch 88 on, the circuit board provides low voltage DC power to the electrical cable 138 in the hose passageway. Although the vacuum inlet port 150 of the hand tool 20 will always be sucking in air unless the main power switch 88 switched off or the recovery tank assembly 16 is full, the agitation and liquid can be controlled independently of each other from the hand tool using the spray trigger 146 and agitator switch 154.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A liquid extraction cleaning device comprising:

a main unit, the main unit comprising a vacuum pump;

a liquid pump;

a flexible hose surrounding a hose passageway, the flexible hose being operatively connected to the vacuum pump in a manner such that the vacuum pump is capable of drawing fluid through the hose passageway;

a hand tool, the hand tool comprising a vacuum inlet port, an agitator, an electric motor, a spray nozzle, and a grip portion, the hand tool being connected to the main unit by the flexible hose such that the hand tool is movable relative to the main unit, the vacuum inlet port being operatively connected to the vacuum pump via the hose passageway in a manner such that the vacuum pump is capable of drawing fluid through the vacuum inlet port and into the hose passageway, the spray nozzle being operatively connected to the liquid pump in a manner such that the liquid pump is capable of forcing liquid out of the spray nozzle, the electric motor being operatively connected to the agitator in a manner such that operation of the electric motor causes the agitator to move relative to the grip portion; and an electrical cable extending within and along the hose passageway, the electrical cable being operatively connected to the electrical motor of the hand tool and to the main unit in a manner such that the electrical cable can supply electrical power to the electric motor from the main unit.

2. A liquid extraction cleaning device in accordance with claim 1 wherein the hand tool comprises an agitator switch and the agitator switch is configured and adapted to control whether the electric motor receives electricity.

3. A liquid extraction cleaning device in accordance with claim 2 wherein the liquid extraction device is configured and adapted such that the electric motor of the hand tool operates on direct current below twenty-five volts supplied via the main unit through the electrical cable.

4. A liquid extraction cleaning device in accordance with claim 1 wherein the electric motor is configured to pivotally reciprocate the agitator and the agitator comprises bristles.

5. A liquid extraction cleaning device in accordance with claim 1 wherein the hand tool comprises a spray switch and the spray switch is configured and adapted to control the operation of the liquid pump in a manner controlling whether liquid is sprayed out of the spray nozzle.

6. A liquid extraction cleaning device in accordance with claim 5 wherein the spray switch is an electrical switch, the liquid pump is electrically powered, and the spray switch is configured and adapted to control whether the liquid pump receives electricity.

7. A liquid extraction cleaning device in accordance with claim 6 wherein the hand tool comprises an agitator switch, the agitator switch is configured and adapted to control whether the electric motor receives electricity, and the spray and agitator switches can independently control the operation of the liquid pump and electric motor respectively.

8. A liquid extraction cleaning device in accordance with claim 6 wherein the liquid pump is fixed in position relative to the main unit, the electrical cable comprises multiple electrical wires, and the spray switch controls the operation of the liquid pump via at least one of the electrical wires.

9. A liquid extraction cleaning device in accordance with claim 8 wherein the liquid extraction device is configured and adapted such that the electric motor of the hand tool and the spray switch operate on direct current below twenty-five volts, and the liquid pump is configured and adapted to operate on alternating current.

10. A liquid extraction cleaning device in accordance with claim 8 wherein the main unit comprises a recessed cradle configured and adapted to releasably hold the hand tool when the liquid extraction cleaning device is stored in a manner such that the spray nozzle of the hand tool is above the liquid pump and the flexible hose during storage.

11. A liquid extraction cleaning device in accordance with claim 10 wherein the main unit comprises a hose storage receptacle, and the hose storage receptacle is configured and adapted to releasably hold the flexible hose beneath the spray nozzle of the hand tool during storage.

12. A liquid extraction cleaning device in accordance with claim 8 wherein the hand tool comprises an agitator switch, the agitator switch is configured and adapted to control whether the electric motor receives electricity, and the spray and agitator switches can independently control the operation of the liquid pump and electric motor respectively.

* * * * *